US006901683B2

(12) United States Patent
Lyle et al.

(10) Patent No.: US 6,901,683 B2
(45) Date of Patent: Jun. 7, 2005

(54) METHOD AND APPARATUS FOR ELECTROMAGNETIC DRYING OF PRINTED MEDIA

(75) Inventors: Ruthie D. Lyle, Durham, NC (US); Jennifer Q. Trelewicz, Superior, CO (US); Carl Robert Bildstein, Superior, CO (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/642,993

(22) Filed: Aug. 18, 2003

(65) Prior Publication Data

US 2004/0055175 A1 Mar. 25, 2004

Related U.S. Application Data

(62) Division of application No. 10/076,985, filed on Feb. 15, 2002.

(51) Int. Cl.[7] ..... F26B 3/34

(52) U.S. Cl. ..... 34/265; 34/418; 34/259; 219/690; 219/696

(58) Field of Search ..... 34/245, 259, 664, 34/265, 418, 427; 219/690, 691, 696

(56) References Cited

U.S. PATENT DOCUMENTS

| | | | | |
|---|---|---|---|---|
| 3,491,457 A | | 1/1970 | Schreiber et al. | |
| 3,560,694 A | * | 2/1971 | White | 219/693 |
| 3,597,567 A | | 8/1971 | Johnson | |
| 3,672,066 A | | 6/1972 | Stephansen | |
| 3,678,594 A | | 7/1972 | Goerz, Jr. et al. | |
| 3,722,105 A | | 3/1973 | Marteny | |
| 3,740,515 A | * | 6/1973 | Vankoughnett | 219/693 |
| 3,764,768 A | | 10/1973 | Sayer, Jr. | |
| 3,846,606 A | | 11/1974 | Edgar et al. | |
| 3,851,132 A | | 11/1974 | VanKoughnett | |
| 4,035,599 A | | 7/1977 | Kashyap et al. | |
| 4,234,775 A | | 11/1980 | Wolfberg et al. | |
| 4,638,571 A | | 1/1987 | Cook | |
| 4,823,477 A | | 4/1989 | Soininen | |
| 4,841,989 A | * | 6/1989 | Kikuchi et al. | 607/154 |
| 5,064,979 A | | 11/1991 | Jaeger | |
| 5,169,571 A | * | 12/1992 | Buckley | 264/463 |

(Continued)

FOREIGN PATENT DOCUMENTS

| | | |
|---|---|---|
| DE | 34 45 615 | 6/1986 |
| DE | 37 02 218 | 10/1987 |
| DE | 196 16 692 | 11/1997 |
| EP | 0 071 123 | 2/1983 |
| GB | 1 236 374 | 6/1971 |
| GB | 2 227 823 A | 8/1990 |
| JP | 06-294091 | 10/1994 |
| JP | 10-112384 | 4/1998 |
| JP | 10-112385 | 4/1998 |
| NL | 9001575 | 2/1992 |
| WO | 99/42774 | 8/1999 |

*Primary Examiner*—Denise L. Esquivel
*Assistant Examiner*—Kathryn S. O'Malley
(74) *Attorney, Agent, or Firm*—Crawford Maunu PLLC

(57) ABSTRACT

A method, apparatus and article of manufacture for providing electromagnetic drying of printed media. A resonant cavity allows support of standing waves along many radial axes throughout the resonant cavity. The electromagnetic drying unit allows forced air to be introduced into the resonant cavity, thereby reducing moisture within the resonant cavity and extending the life of the resonant cavity. Input and output openings may be arranged longitudinally along the resonant cavity and may be designed to substantially reduce the amount of electromagnetic radiation emanating from them during operation. A honeycomb feature at the end of the resonant cavity may allow egress of the forced air, while substantially reducing the amount of electromagnetic radiation emanating from the end of the resonant cavity.

12 Claims, 6 Drawing Sheets

U.S. PATENT DOCUMENTS 5,423,260 A 6/1995 Goldberg et al.
5,536,921 A 7/1996 Hedrick et al.
5,631,685 A * 5/1997 Gooray et al. ..... 347/102
5,814,138 A 9/1998 Fague
5,958,275 A 9/1999 Joines et al.
6,075,232 A 6/2000 Joines et al.
6,087,642 A 7/2000 Joines et al.
6,097,019 A 8/2000 Lewis et al.
6,121,595 A 9/2000 Lewis et al.
6,207,941 B1 * 3/2001 Schmidt et al. ..... 219/690
6,247,246 B1 * 6/2001 Scalese et al. ..... 34/259
6,346,693 B1 * 2/2002 Kasevich ..... 219/746

* cited by examiner

METHOD AND APPARATUS FOR ELECTROMAGNETIC DRYING OF PRINTED MEDIA

RELATED PATENT DOCUMENTS

This is a divisional of patent application Ser. No. 10/076,985, filed on Feb. 15, 2002, to which Applicant claims priority under 35 U.S.C. §120.

BACKGROUND OF THE INVENTION

1. Field of the Invention

This invention relates in general to print output apparatus and methods, and more particularly, to a method and apparatus for electromagnetic drying of printed media.

2. Description of Related Art

In electronic print devices for printing, copying and desktop publishing systems, images are usually offered in electronic form, and are then referred to as electronic images. These electronic images can be stored on magnetic disk or transported via direct links or networks to the print devices. The creation of a page results in an electronic data stream or electronic file describing the several elements of the page layout in electronic format. This electronic page layout is usually expressed in a page description language. The electronic page layout comprises the data for each electronic image that must appear on the printed reproduction.

Several print technologies exist today to provide the printed reproduction of each electronic image including, but not limited to, inkjet and laser technology. For inkjet printing, the printer sprays tiny droplets of ink onto the print media, to recreate the electronic images onto hard copy. Many of the inks used in inkjet technology are water based, so the ink's solvent must be able to evaporate or be absorbed into the media, e.g., continuous web, within a reasonable amount of drying time. Drying of the ink is the process of absorption or evaporation of the ink's solvent into the web or atmosphere while the pigment ideally remains on the surface. Drying techniques can be employed to facilitate the drying of the ink, so that for example, the ink's pigment remains at the web surface with minimal ink spread and feathering to produce sharp, dense images. Power dissipated in the inked web helps to facilitate drying at a faster rate.

High-speed, inkjet printers must be able to dry the ink of the printed media very quickly and with reasonable power constraints. One method of drying the printed media uses a heated drying unit.

In addition to the excessive power consumption problem of the heated drying unit, a safety and scorching hazard is introduced when the paper is delayed while passing through or across the heated drying unit. Since the drying unit is slow to cool, the safety and scorching hazard may remain active for some time. Furthermore, the operator must wait a lengthy time for the dryer to cool to avoid a bum hazard when clearing paper from the dryer.

An additional problem encountered with dryers is that the elements used by the dryers are slow to heat. This time directly adds to the warm-up time required by the printer. Obviously, any warm-up time required by the printer adds to the total time required by the print job, which ultimately slows the operation of the printer.

A further problem posed by radiant heat dryers is the selectivity to the color of the ink. For example, darker colored ink may get hotter than the lighter colored ink and thus evaporate at a faster rate than does lighter colored ink.

Multicolored media, such as preprinted forms, when exposed to the radiant heat, may experience local puckering of the media where the ink is darkest. Conversely, lighter colors may not dry as well, since less heat may be absorbed by the lighter colored ink, which causes slower evaporation of the water content.

It can be seen, therefore, that there is a need for a method, apparatus and article of manufacture for providing instant-off, instant-on drying for printed media. Not only does the efficiency of the drying increase, but so does the safety of the device. Furthermore, a more uniform method of drying is required so that inked media may be dried at approximately the same rate, regardless of the color of the ink used.

SUMMARY OF THE INVENTION

To overcome the limitations in the prior art described above, and to overcome other limitations that will become apparent upon reading and understanding the present specification, the present invention discloses a method, apparatus and article of manufacture for electromagnetic drying of printed media.

The present invention solves the above-described problems by providing instant-on and instant-off electromagnetic drying control which improves drying efficiency and reduces output power consumption, reduces safety hazards, and provides uniform drying independent of ink color. Additionally, the electromagnetic drying unit provides attenuation features used to substantially eliminate electromagnetic radiation outside of the drying unit.

A method in accordance with the principles of the present invention includes receiving printed media through an input opening, drying the printed media using an electric field formed within a resonant cavity, and passing the printed media through an output opening. The input and output openings substantially attenuate the electromagnetic signal.

In another embodiment of the present invention an electromagnetic drying apparatus is provided. A resonant cavity receives an electromagnetic signal at a first end and attenuates the electromagnetic signal at a second end. An input opening is coupled to the resonant cavity to receive media having a first moisture content and is coupled to propagate the media into the resonant cavity. An output opening is coupled to receive media having a second moisture content from the resonant cavity. The second moisture content is less than the first moisture content.

In another embodiment of the present invention a printed media drying apparatus is presented. The apparatus includes an electromagnetic drying unit to promote absorption of electromagnetic radiation by moisture particles contained within the printed media. The electromagnetic drying unit includes a chamber having a plurality of orifices coupled to receive printed media having a first moisture content and is coupled to provide the printed media having a second moisture content less than the first moisture content. The chamber substantially reduces leakage of the electromagnetic radiation through the plurality of orifices.

In another embodiment of the present invention an article of manufacture including a program storage medium readable by a computer is provided. The medium tangibly embodies one or more programs of instructions executable by the computer to perform a method for drying printed media. The method includes receiving the printed media through an input opening, drying the printed media using an electric field formed within a resonant cavity, and passing the printed media through an output opening. The input and output openings substantially attenuate the microwave signal.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout.

DETAILED DESCRIPTION OF THE INVENTION

In the following description of the exemplary embodiment, reference is made to the accompanying drawings that form a part hereof, and in which is shown by way of illustration the specific embodiment in which the invention may be practiced. It is to be understood that other embodiments may be utilized as structural changes may be made without departing from the scope of the present invention.

The present invention provides a method, apparatus and article of manufacture for drying printed media in a printing device using electromagnetic, e.g. microwave, radiation. The microwave heaters according to the present invention provide instant-on and instant-off heating, which reduces the warm-up time required by the microwave heater as well as reducing safety and fire concerns, when for example, the web becomes jammed within the printing device. Furthermore, microwave heaters according to the present invention allow operation at chosen frequencies, which facilitates a higher drying efficiency as compared to radiating drying units and lowers the amount of power required.

Figure 1:
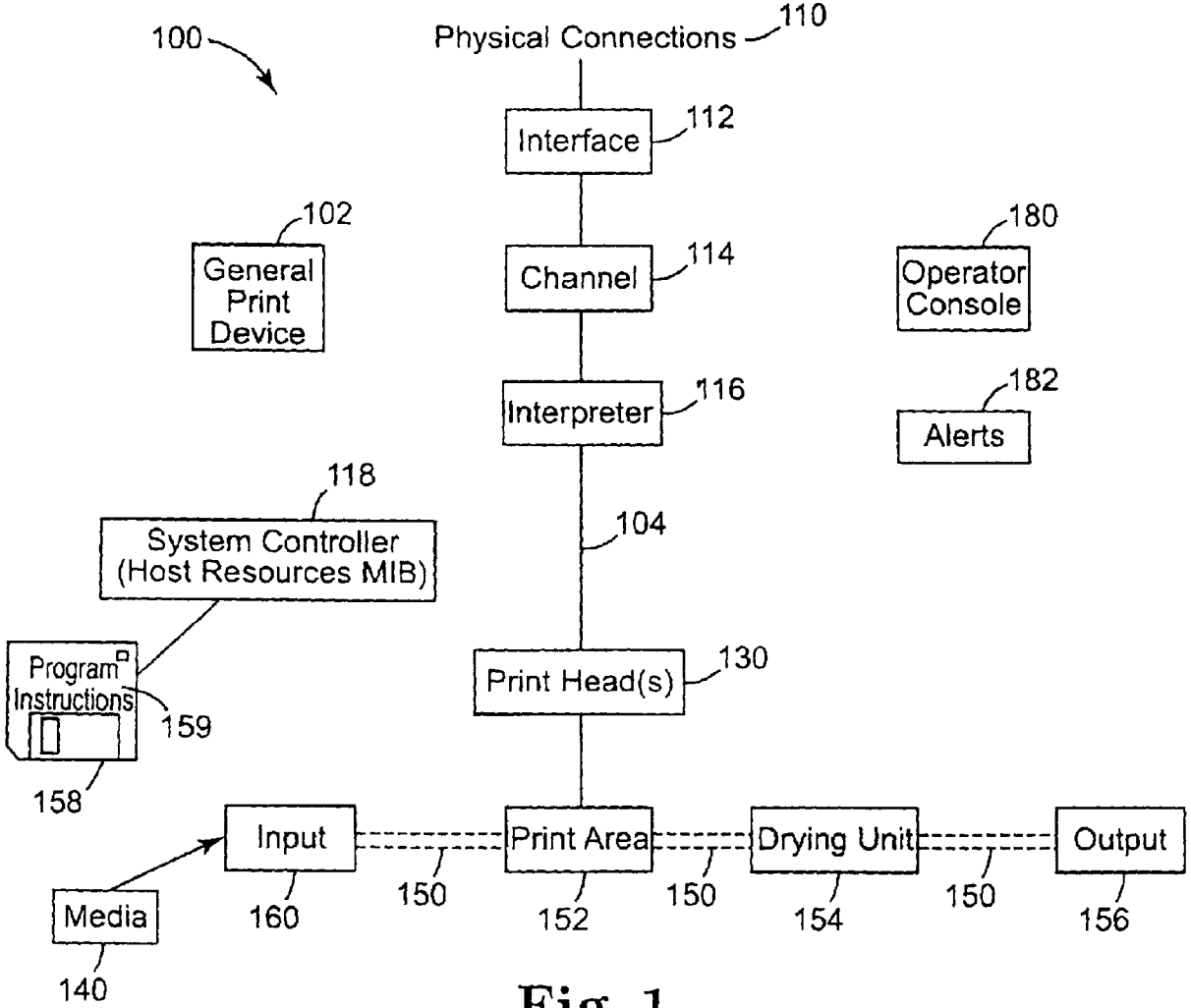
FIG. 1 illustrates a block diagram of a print device.

FIG. 1 illustrates a block diagram of a print device 100, such as an inkjet printer or any other print device employing water-based ink technology, according to the present invention. Those skilled in the art will recognize that the sub-units of the print device illustrated in FIG. 1 may not necessarily relate directly to any physically identifiable mechanism. Sub-units can also be a set of definable logical processes, such as interpreters for page description languages or command processors that set various operating modes of the print device.

FIG. 1 illustrates the three basic functions of the print device: (1) the flow of a print file into an interpreter and onto the print head 130, (2) the flow of media across the print heads and (3) the auxiliary sub-units that control and facilitate the two flows. As shown in FIG. 1, the flow of the print data comes through a physical connection 110 on which some form of transport protocol stack is running to a print device interface 112. The physical connection 110 could be a wired or wireless network connection, or fiber optics, or other means of transporting data. The data provided by the transport protocol (interface) appears on a channel 114. The channel 114 provides the data stream to the input of an interpreter 116. The interpreter 116 is responsible for the conversion of a description of intended print instances into images that are to be marked on the media. A print device may have one or more interpreters.

As shown in FIG. 1, the media 140 is selected by input 160 and then transported via a media path 150 first to a print area 152, then into a drying unit 154 via media path 150 and finally ending into output 156. The input 160 is a mechanism that feeds media to be marked into the print device. Print head 130 is the mechanism that produces marks on the print media 140. A print device can contain one or more print heads 130. Each print head 130 can have its own set of characteristics, such as ink color, associated with it. The media paths 150 encompass the mechanisms in the print device that move the media through the print device and connect all other media related units: input 160, output 156, and print heads 130. A print device may contain one or more media paths 150. In general, the design of the media paths 150 determines the maximum speed of the print device as well as the maximum media size that the print device can handle. Media paths 150 are complex mechanisms and can contain many different identifiable sub-mechanisms such as media movement devices, media buffers, and interlocks.

The auxiliary sub-units, such as the general print device 102, operator console 180 and alerts 182, facilitate control of the print device, inquiry/control of the operator panel, reporting of alerts, and the adaptation of the print device to various natural languages and character sets. The general print device 102 is responsible for the overall control and status of the print device. The operator console 180 is used to display and modify the state of the print device. The operator console 180 can be as simple as a few indicators and switches or as complicated as full screen displays and keyboards. The alert unit 182 is responsible for detecting reportable events, making an entry in the alert table and, if and only if, the event is a critical event, initiating a trap. For example, if media is not loaded, or becomes jammed, in the print device, then the problem could be communicated back to the host on an interrupt basis.

All of the above described functions run on the system controller 118, which represents the processor, memory and storage systems of the print device. The system controller 118 implements the control functions for processing a print job. The control functions, as will be described below with reference to FIGS. 2–5, may be tangibly embodied in a computer-readable medium or carrier, e.g. one or more of the fixed and/or removable data storage devices 158, or other data storage or data communications devices. The program instructions 159 of the storage device 158 may be loaded into System Controller 118 to configure the System Controller 118 for execution. The program instructions 159 comprise instructions which, when read and executed by the System Controller 118 causes the System Controller 118 to perform the steps necessary to execute the steps or elements of the present invention.

The system controller 118 includes the Management Information Base (MIB), which provides access to data elements of the print device, such as the processor(s), memory, disk storage, file system and other underlying sub-mechanisms of the print device. The system controller 118 can range from simple single processor systems to multiprocessor systems. In addition, controllers can have a full range of resources such as hard disks. Those skilled in the art will recognize that a print device may have more than one processor and multiple other resources associated with it.

Drying unit 154 implements electromagnetic, or microwave, radiation to facilitate drying of the inked media according to the present invention. The power density dissipated by the inked paper may be written in the form $P=\square E^2$ (watts/$m^3$) where □ denotes the electrical properties of the ink and E is the applied electric field (E-field). Since □ is fixed by the properties of the ink, drying power is controlled through the applied E-field. For example, increasing the magnitude of the E-field increases the amount of dissipated heat in the inked media. As heat is dissipated in the inked media, the amount of water decreases, which causes a decrease in the heat dissipation. Therefore, a peak operating point of water evaporation vs. applied electric field strength is established.

Figure 2:
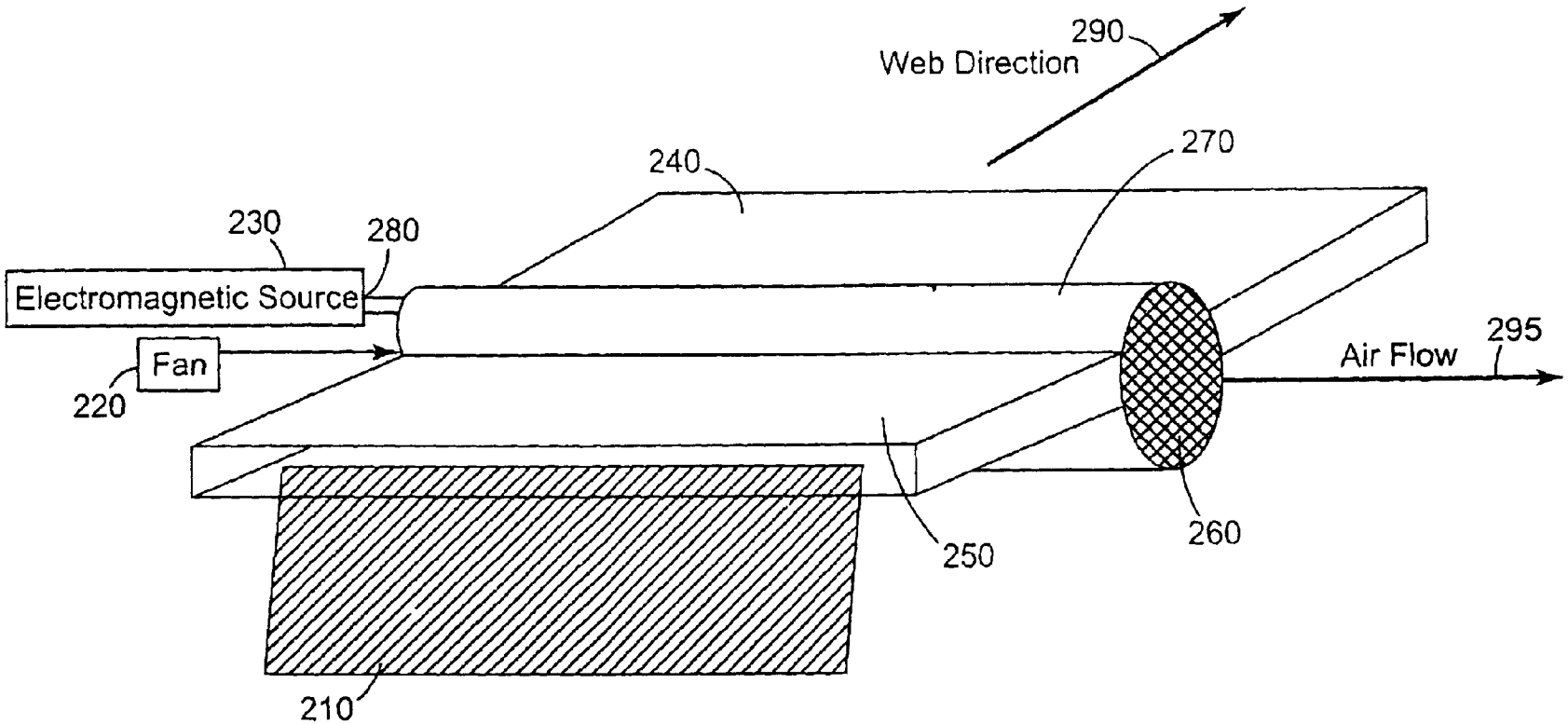
FIG. 2 illustrates an electromagnetic drying unit according to the present invention.

FIG. 2 illustrates an exemplary illustration of microwave heating unit 200 employing resonant cavity 270, input opening, or waveguide, 250 and output opening, or waveguide, 240. Inked media enters microwave heating unit 200 via the input waveguide 250 and exits the microwave heating unit 200 via output waveguide 240. Microwave heating unit 200 may be used as the drying unit 154 as illustrated in FIG. 1. Electromagnetic source 230 transmits high frequency electromagnetic energy into resonant cavity 270 to establish E-fields in a resonant condition within the resonant cavity. Microwave source 230 is selected for the E-field required and is adjusted for loss, the loss being created by at least the cavity shape, material, and media 210 entering the resonant cavity 270. A microwave chamber is formed by the combination of resonant cavity 270 in combination with input waveguide 250 and output waveguide 240. Resonant modes in the chamber are superimposed to create the E-field through which the paper passes for heating. The length of the resonant cavity 270 and the shape of waveguide 280 through which the transmitted energy enters resonant cavity 270 are designed to excite specific modes that superimpose to produce an E-field that is flat within a range that will produce uniform heating. The heating is advantageously centered within resonant cavity 270, such that the trajectory of media 210, as it passes through resonant cavity 270, traverses a substantially flat and constant E-field to facilitate uniform drying of media 210. A fan 220 may be positioned at one end of the resonant cavity 270, so that forced air may be introduced into the resonant cavity perpendicular to the direction of movement of the web as shown by arrow 290 to remove excess moisture within resonant cavity 270.

Another method used to insure uniform drying of media 210 is through the use of Frequency Modulation (FM). Uniform heating in resonant cavity 270 may be achieved by frequency modulating microwave source 230. The absorption peak of water has a non-zero bandwidth, meaning that high absorption may be obtained across a non-zero frequency range centered about a center frequency. By frequency modulating the center frequency of microwave source 230, a non-zero frequency band is established having a center frequency equal to the transmission frequency of microwave source 230 with a bandwidth directly proportional to the peak frequency deviation of the FM signal. Accordingly, high absorption is achieved for a few MHz on either side of the center frequency of microwave source 230. FM changes the locations of peaks and nulls in the resonant modes within resonant cavity 270 and thus a more uniform heating solution is produced.

FM may be accomplished in one of several ways. A phase shifter, for example, such as a PIN diode, may be placed in series with a microwave transmitter contained within microwave source 230. The PIN diode is a non-linear device designed to multiply the frequency deviation of the microwave transmitter by a given factor. Another method to obtain a frequency modulation of microwave source 230 is to provide an asymmetrically slotted waveguide 280 attached to microwave source 230 and rotated to change the resonant characteristics of resonant cavity 270.

Microwave drying unit 200 may be implemented with a cylindrical resonant cavity 270 having circular or elliptical ends on either side of the web, or media 210. A honeycomb structure 260 is formed at the end of resonant cavity 270 to allow egress of the forced air generated by fan 220. The forced air produced by fan 220 removes moist air from resonant cavity 270, which improves evaporation and reduces corrosion. In addition, the honeycomb structure 260 provides substantial attenuation of the microwave radiation generated by microwave source 230, such that the microwave radiation is substantially contained within resonant cavity 270, while the forced air is allowed to exit.

Inside resonant cavity 270, microwave energy generated by microwave source 230 is directed through a waveguide 280 that runs the length of the resonant cavity 270. The waveguide 280 contains slots, which allows the microwave energy to pass into the resonant cavity 270. The locations of the slots are chosen carefully in order to excite the desired resonant modes. Proper slot location allows the microwave energy to be spread through the resonant cavity 270 along the line of drying without using a continuously-moving device to recirculate the waves. Proper slot location, therefore, allows for a reduction in the number of movable parts required within microwave drying unit 200, thus potentially increasing reliability. The waveguide attached to the source will allow the formation of standing waves inside the resonant cavity, however, it is desired that the total energy be dispersed along a line perpendicular to the process direction 290. Energy dispersion is facilitated by engineering the interior shape of the chamber, through, for example, machining or etching techniques. If found to be more effective for high-speed drying, the interior chamber shape may be designed for all energy to be focused in a "hot spot" along a line in the web, at which the majority of drying occurs.

Depending on the sustainability of resonance in the chamber, microwave source may be run with a duty cycle <1 to conserve power. Additionally, the dimensions of microwave drying unit 200 are smaller than the dimensions of a radiant heating unit of equivalent heating capacity, which leads to several advantages.

One advantage of microwave drying unit 200, is the considerable reduction in size as compared to radiant dryer units. A smaller footprint allows several drying units to be employed within a single print application, such as for example, the use of a drying unit between multiple color stations. Drying stations may be placed between color stations, reducing bleed and wicking/migration between pixels on the paper, thereby improving print quality. It should be noted that although the cylindrical shape of resonant cavity 270 provides for compact design and the excitation of specific modes that superimpose to produce an E-field that is flat within a range to produce uniform heating, those of ordinary skill in the art will recognize that any shape, such as elliptical or spherical, may also be used for resonant cavity 270 having similar advantages.

Another advantage afforded by microwave drying unit 200 allows the total paper path to be made shorter than the paper path associated with radiant dryers, reducing the length of backhitches and simplifying threading. Microwave drying unit also allows a substantially straight paper path. The total paper path is made straighter than the paper paths associated with radiant drying units for a fixed cabinet size. The straighter paper path simplifies threading and reduces the probability of jams and paper path problems. Even more importantly, a straighter paper path simplifies the registration problem by providing fewer opportunities for elasticity in the paper to affect registration.

Web 210 enters cylinder 270 along the long axis of cylinder 270 through a lossy slot, or input waveguide 250. Advantageously, the input waveguide 250 is made to be lossy at the slot where media 210 enters the waveguide in order to reduce leaked radiation and to avoid Electro-Magnetic Interference (EMI) problems. For example, the input waveguide might be machined with quarter-wavelength stub-outs to attenuate microwave energy at the slot as shown in FIG. 3*a*.

Figure 3A:
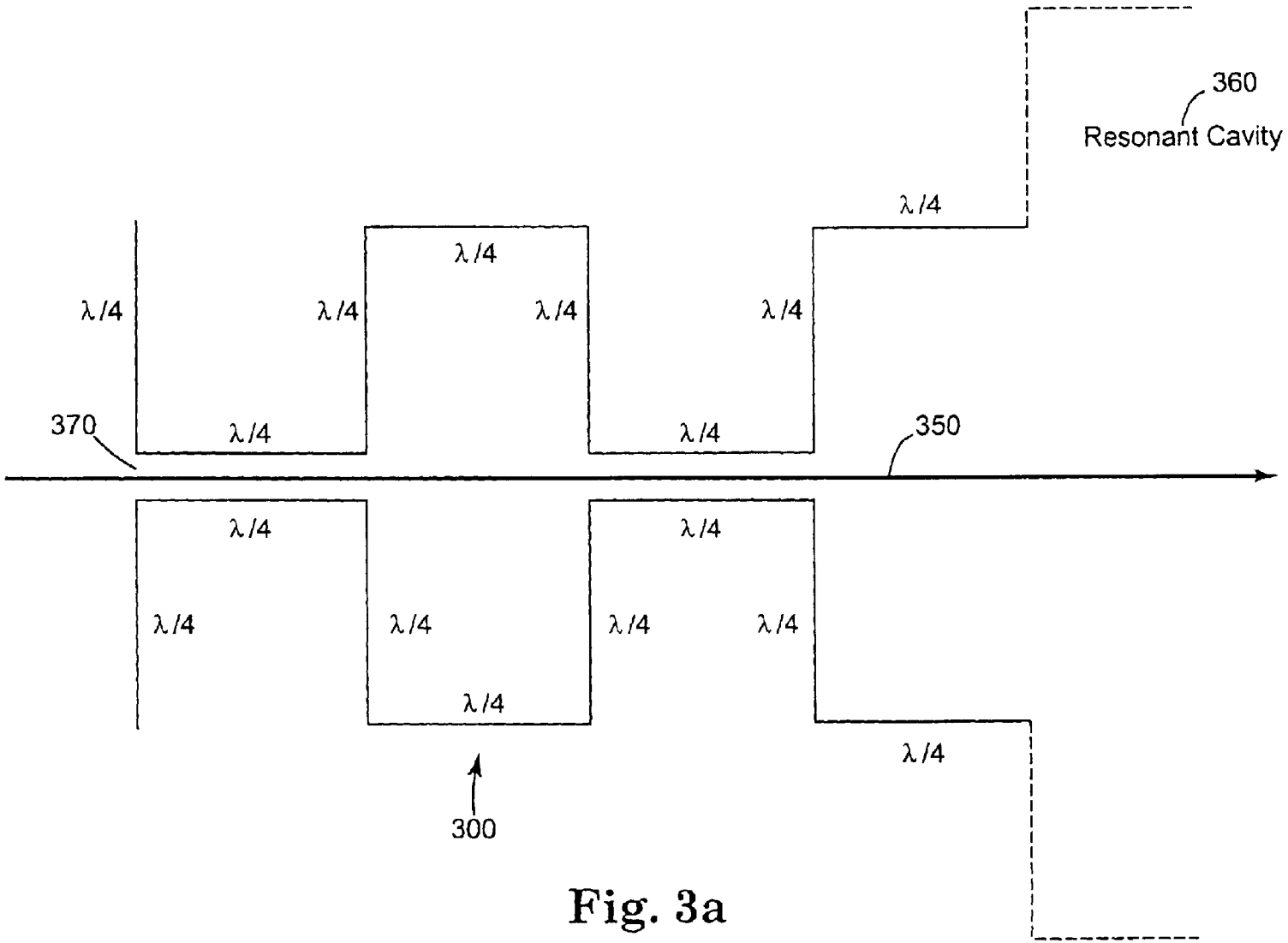
FIG. 3*a* illustrates attenuation stubs of an input waveguide.

FIG. 3*a* illustrates an exemplary input waveguide 300 having quarter-wavelength (□/4) stubs formed within the waveguide. Resonant cavity 360 supports E-fields that are substantially flat within a range to produce uniform heating along the path 350 taken by the inked media. The quarter-wavelength stubs are created to produce a significant amount of attenuation along the entire length of the input waveguide so that electromagnetic radiation at slot 370 is substantially reduced. The inked media enters resonant cavity 360 via the input waveguide at slot 370 in the direction of arrow 350 and exits resonant cavity 360 via an output waveguide (not shown) having substantially the same stub arrangement as shown for input waveguide 300.

Figure 3B:
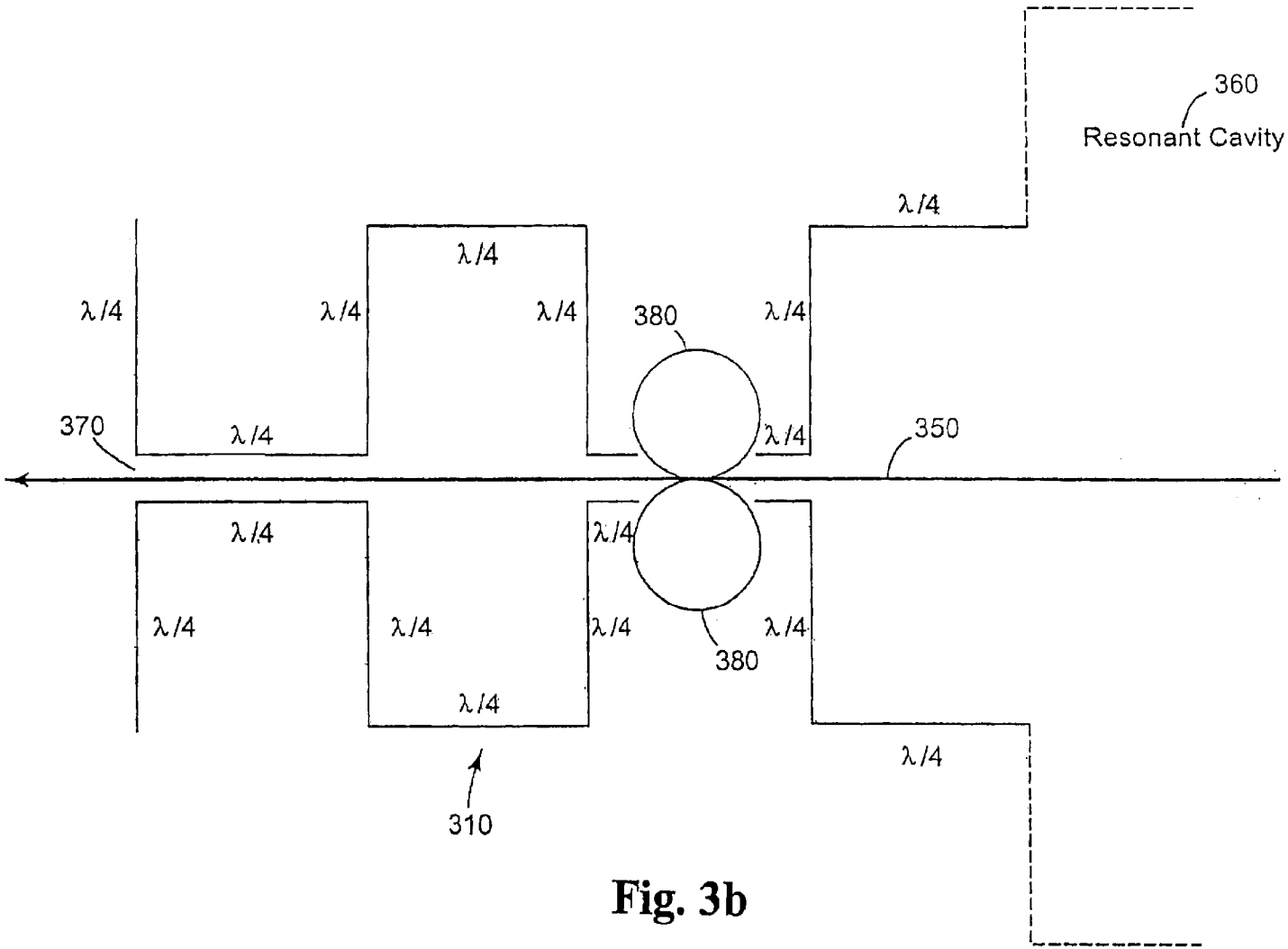
FIG. 3*b* illustrates pinch rollers in the output cavity.

FIG. 3*b* illustrates an exemplary output waveguide 310 having pinch rollers 380 within the waveguide. Resonant cavity 360 supports E-fields that are substantially flat within a range to produce uniform heating along the path 350 taken by the inked media. The pinch rollers 380 are manufactured of conductive material to produce a significant amount of attenuation along the entire length of the output waveguide so that electromagnetic radiation at slot 370 is substantially reduced. The inked media enters resonant cavity 360 via the input waveguide (not shown) and exists via output waveguide at slot 370 in the direction of arrow 350.

Figure 4:
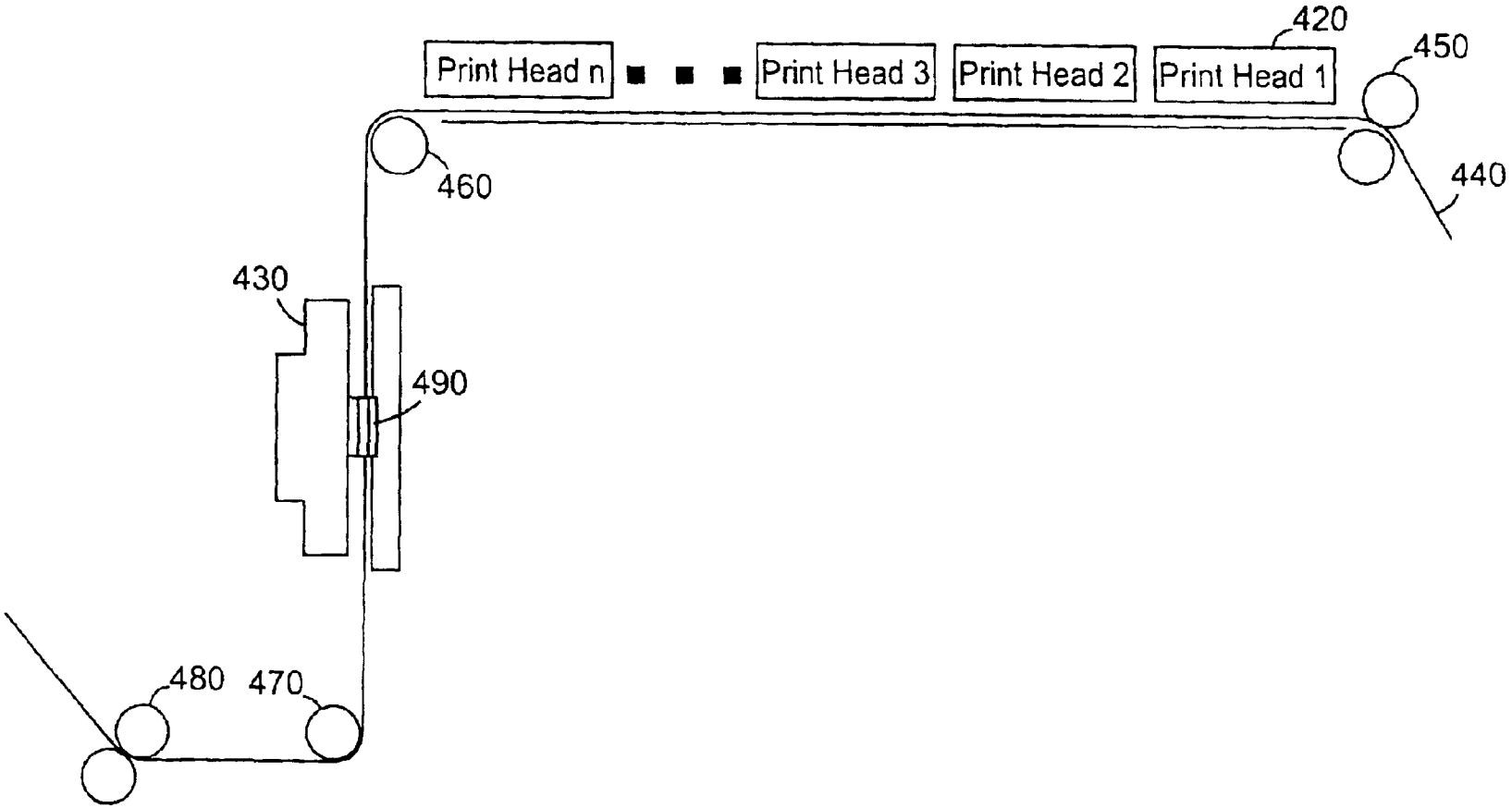
FIG. 4 illustrates a continuous web print device utilizing an electromagnetic drying unit according to the present invention.

FIG. 4 illustrates one conceptualization of a continuous web printer 400 using a microwave heating unit 430 according to the present invention. The continuous web 440 is threaded through input rollers 450, through position rollers 460 and 470 and finally through output rollers 480. Print heads 420 are positioned over continuous web 440 to provide marking capability. Ink used by print heads 420 should have high efficiency of absorption of electromagnetic radiation, as in the case of water-based technologies of the high efficiency of absorption of microwave radiation by water molecules. Other advantages of water-based inks are, for example, chemical safety and ease of cleaning.

The drying unit 430 is fitted with a hinge 490, so that it can be opened to assist with paper threading. The hinge assembly is subsequently connected to triple interlocks to ensure that the microwave source is turned off while the cavity is open. The triple lock system is used to prevent operators and service personnel from being exposed to high levels of microwave energy. As with microwave ovens used in many residential and commercial kitchens, the inside of the cavity does not become hot, rather only those materials containing water inside the cavity heat up during operation. As such, the cavity will not become hot, making the cavity safer for the operator during threading operations. The microwave source of drying unit 430 may become hot during operation, however, so shields may be used around the source to prevent contact with the operator's hands.

Since the microwaves at the chosen frequency are preferentially absorbed by water molecules, only the ink and to a lesser extent, the paper, is heated during drying. The amount of energy that is transmitted by the source can be chosen for web speed, forms type, and coverage, so that the paper is not made to be hotter than necessary for drying. Additionally, the transmitter may be turned on instantly, so that drying is immediately available during printing increasing the efficiency of operation since extended warm-up time is not required. The transmitter may also be turned off instantly, which significantly increases the safety of operation of drying unit 430.

The microwave source contained within drying unit 430 may be implemented using, for example, magnetrons or klystrons. Klystrons are advantageously used for the microwave source because of the availability of high-power klystrons. Magnetrons generally are only available up to about 10 kilowatts (kW), such that any higher power levels requires combining several magnetrons for added output power. Several options for high-power klystrons exist that support power levels between 15 kW and 100 kW at 75% efficiency. A circulator (not shown) is generally used at the output of the microwave source, in order to substantially prevent any reflected microwave energy from reentering the magnetron or klystron, significantly extending the life of the magnetron or klystron.

Output power of the microwave source in dryer unit 430 may be regulated by measuring the Voltage Standing Wave Ratio (VSWR) in the resonant cavity of the drying unit. The VSWR in the resonant cavity is measured while the drying unit is operational, allowing the calculation of the absorption of electromagnetic energy by the paper, which is directly proportional to the amount of water in the paper. The amount of drying needed by the print media, therefore, is monitored in real time. The amount of drying needed is then used to do on-the-fly adjustment of dryer output power, which is effective to conserve the amount of power required by drying unit 430. The amount of power required by dryer unit 430 may also be increased in real time for high-coverage and high-speed jobs. Conversely, VSWR measurements may enable the print system controller to slow the job down if high coverage is impeding sufficient drying.

Although continuous web media drying is exemplified, those skilled in the art will recognize that single sheet media may also be utilized in accordance with the present invention. The microwave drying unit of FIG. 2, for example, is readily adaptable to provide single page drying as would be required, for example, in personal or business applications using single sheet tray feeders.

Accordingly, the present invention provides a method, apparatus and an article of manufacture for providing electromagnetic drying of printed media. A cylindrical resonant cavity allows support of standing waves along many radial axes throughout the resonant cavity. The electromagnetic drying unit allows forced air to be introduced into the resonant cavity, thereby reducing moisture within the cavity and extending the life of the resonant cavity. Input and output waveguides are arranged longitudinally along the cylindrical resonant cavity and are designed to substantially reduce the amount of electromagnetic radiation emanating from them during operation. A honeycomb feature at the end of the resonant cavity allows egress of the forced air, while substantially reducing the amount of electromagnetic radiation emanating from the end of the resonant cavity.

Figure 5:
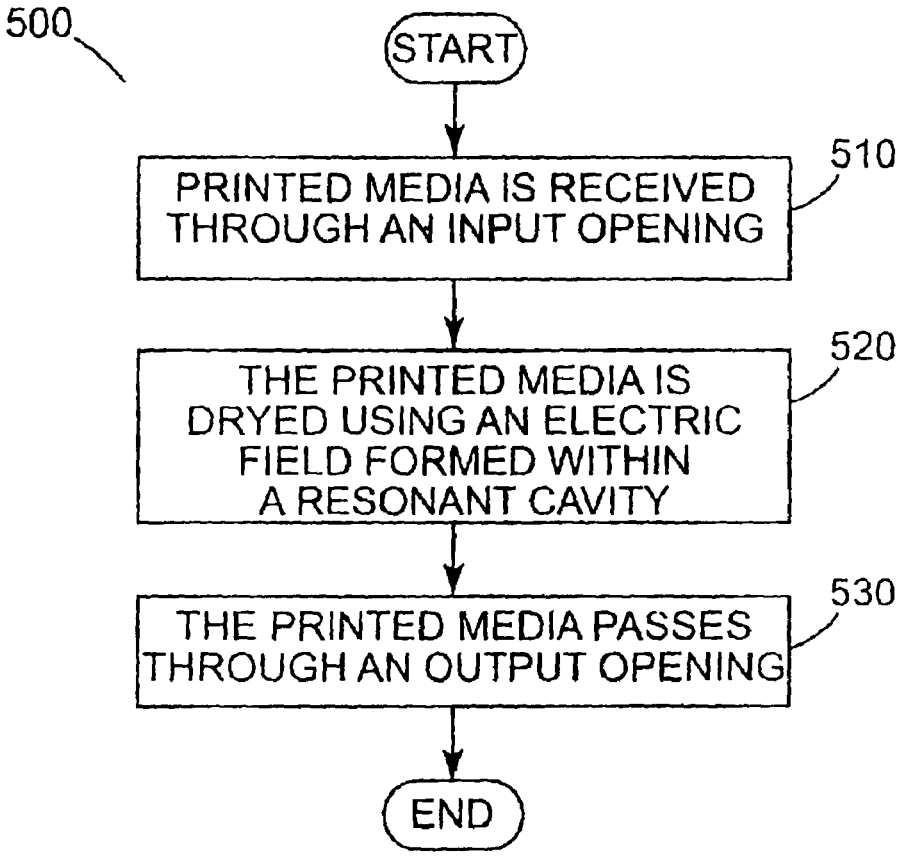
FIG. 5 is a flow chart illustrating the electromagnetic drying of printed media process.

FIG. 5 is a flow chart 500 illustrating the electromagnetic drying of printed media process. In FIG. 5, printed media is received through an input opening 510. The printed media is dried using an electric field formed within a resonant cavity 520. The printed media passes through an output opening 530. The input and output openings substantially attenuate the electric field.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A method of drying printed media using an electromagnetic signal, comprising:

receiving printed web media at an input opening of a resonant cavity;

drying the printed media using an electric field formed within the resonant cavity and using forced air directed perpendicular to the input opening within the resonant cavity, the forced air egressed from the resonant cavity via an attenuation structure, the attenuation substantially attenuating electric field emissions from the attenuation structure; and passing the printed media through an output opening, wherein the input and output openings substantially attenuate electric field emissions from the input and output openings;

wherein the drying the printed media further comprises measuring in real time the drying of the printed media and adjusting the electric field based on the real time measuring.

2. The method of claim 1, wherein receiving the printed media comprises providing the input opening along a longitudinal axis of the resonant cavity.

3. The method of claim 1, wherein the drying the printed media using an electric field formed within a resonant cavity further comprises drying the printed media using an electric field formed within a resonant cavity having stubs to attenuate the electric field.

4. The method of claim 3, wherein the drying the printed media using an electric field formed within a resonant cavity having stubs further comprises drying the printed media using an electric field formed within a resonant cavity having stubs with critical dimensions substantially equal to a quarter of a wavelength of the electric field.

5. The method of claim 1, wherein drying the printed media using an electric field formed within a resonant cavity further comprises providing the electric field in a line perpendicular to a line between the input and output openings.

6. The method of claim 1, wherein the drying the printed media using an electric field formed within a resonant cavity further comprises focusing the electric field in a localized area for centralized drying.

7. The method of claim 1, wherein the drying the printed media using an electric field formed within a resonant cavity further comprises frequency modulating the electric field.

8. The method of claim 7, wherein the frequency modulating the electric field further comprises using an asymmetrically slotted waveguide attached to a microwave source.

9. The method of claim 8, wherein the using an asymmetrically slotted waveguide attached to a microwave source further comprises exciting selected resonant modes.

10. The method of claim 1, further comprising providing a conductive transport mechanism at the output opening.

11. An article of manufacture comprising a program storage medium readable by a computer, the medium tangibly embodying one or more programs of instructions executable by the computer to perform a method for drying printed media, the method comprising:

receiving printed web media at an input opening of a resonant cavity;

drying the printed media using an electric field formed within the resonant cavity and using forced air directed perpendicular to the input opening within the resonant cavity, the forced air egressed from the resonant cavity via an attenuation structure, the attenuation substantially attenuating electric field emissions from the attenuation structure; and passing the printed media through an output opening, wherein the input and output openings substantially attenuate electric field emissions from the input and output openings;

wherein the drying the printed media further comprises measuring in real time the drying of the printed media and adjusting the electric field based on the real time measuring.

12. A printed media drying device, comprising:

means for receiving printed web media at a resonant cavity;

means for drying the printed media using an electric field formed within the resonant cavity and using forced air directed perpendicular to the input opening within the resonant cavity, the forced air egressed from the resonant cavity via a means for attenuating, the means for attenuating substantially attenuates electric field emissions from the means for attenuating; and means for passing the printed media through an output opening, wherein the means for receiving and the means for passing substantially attenuating electric field emissions therefrom;

wherein the means for drying the printed media further comprises means for measuring in real time the drying of the printed media and adjusting the electric field based on the real time measuring.

* * * * *